US005860600A

United States Patent [19]

Schindler et al.

[11] Patent Number: 5,860,600

[45] Date of Patent: Jan. 19, 1999

[54] ATOMIZER (LOW OPACITY)

[75] Inventors: Edmund S. Schindler, Fairfield; John P. Guarco, Wolcott, both of Conn.

[73] Assignee: Todd Combustion, Shelton, Conn.

[21] Appl. No.: 725,336

[22] Filed: Oct. 1, 1996

[51] Int. Cl.[6] ..... B05B 1/34

[52] U.S. Cl. ..... 239/463; 239/558

[58] Field of Search ..... 239/399, 403, 239/405, 406, 418, 417, 419, 427, 429, 431, 433, 461, 463, 556–558, 590.3, 590.5

[56] References Cited

U.S. PATENT DOCUMENTS 4,790,480 12/1988 Rennie ..... 239/498
4,890,793 1/1990 Fuglistaller et al. ..... 239/427
5,143,297 9/1992 De Michele et al. ..... 239/427
5,368,230 11/1994 Oppenberg ..... 239/433 X

OTHER PUBLICATIONS

CA Low $NO_x$ Burner Retrofits to 240 MW, 300 MW and 400 MW Oil/Gas Fired Utility Boilers; Final Performance Results and Lessons Learned Brochure, J.J. Kuretski, Jr. et al.

*Primary Examiner*—Lesley D. Morris
*Attorney, Agent, or Firm*—Hedman, Gibson & Costigan, P.C.

[57] ABSTRACT

An apparatus in which an atomizer is provided with two arrays of discharge holes adjacent and offset from each other.

17 Claims, 3 Drawing Sheets

ATOMIZER (LOW OPACITY)

FIELD OF THE INVENTION

The invention relates generally to apparatus for dispersing fluids and more specifically to a method and apparatus for atomizing liquids. In particular, the invention relates to an atomizer or front plate for delivery of fuels to burners.

BACKGROUND OF THE INVENTION

Nozzles have long been used to atomize fluids, such as liquids, gases and liquid-solid slurries, to provide fine sprays. One particular application of atomizers that has received considerable attention is in fuel combustion. It is now well known that atomizers that deliver a fine spray of discrete minute droplets improve combustion efficiency.

Thus, considerable work has been done to develop atomizer nozzles that enhance fuel burning efficiency in power plant boilers. It is generally accepted that the finer the fuel spray pattern, the more complete and effective the combustion will be. However, other limitations such as nozzle vibration, tube temperatures, opacity and nitrogen oxide ($NO_x$) emissions must be considered when designing fuel atomizers.

In about 1989 Todd Combustion, Shelton, Conn. developed an atomizer nozzle that improved the combustion efficiency and to some extent reduced $NO_x$ emission. The prior art Todd Combustion atomizer was developed for application in a now conventional furnace windbox.

The Todd atomizer is characterized as a Multi-Jet Single Fluid Atomizer. Structurally the atomizer has a cup-shaped internal whirling chamber into which fuel under pressure is delivered through an array of passages or slots that are arranged tangentially to the whirling chamber. An array of perimeter holes each of which are the same radial distance from the center of the whirling chamber provide passage of the fuel from the whirling chamber to the furnace combustion chamber.

In addition, prior art atomizers with a plurality of perimeter holes such as disclosed in U.S. Pat. No. 5,143,297 also exist.

Although the prior art designs reduced $NO_x$ emissions over previous designs, the level of $NO_x$ emission was still not satisfactory and opacity was higher than desirable. As a result considerable research was conducted to obtain an aerator nozzle capable of reducing opacity to minimal levels.

SUMMARY OF THE INVENTION

It is an object of the present invention to provide an improved atomizer.

It is a further object of the invention to provide an atomizer that will improve boiler combustion efficiency and opacity.

The invention is an atomizer having a centrally disposed whirling chamber into which fuel under pressure is delivered and an outer and inner circular array of holes to provide openings from the centrally disposed whirling chamber to the furnace fire box. The outer array of perimeter holes is arranged at an angle to the centerline of the centrally disposed whirling chamber of about 40°. The inner array of circular holes is arranged at an angle of about 35° to the center line of the centrally disposed whirling chamber. The inner and outer array of perimeter holes are arranged in relationship wherein each individual perimeter hole of the outer array is adjacent to an individual perimeter hole of the inner array to in effect form a pair of holes that have centerlines offset from each other.

DESCRIPTION OF THE DRAWINGS

The invention will be better understood when the description of the preferred embodiment is considered with the following drawings wherein.

DESCRIPTION OF THE PREFERRED EMBODIMENT

The atomizer of this present invention, although having more general application, will be described in the environment of a power plant boiler.

Figure 1:
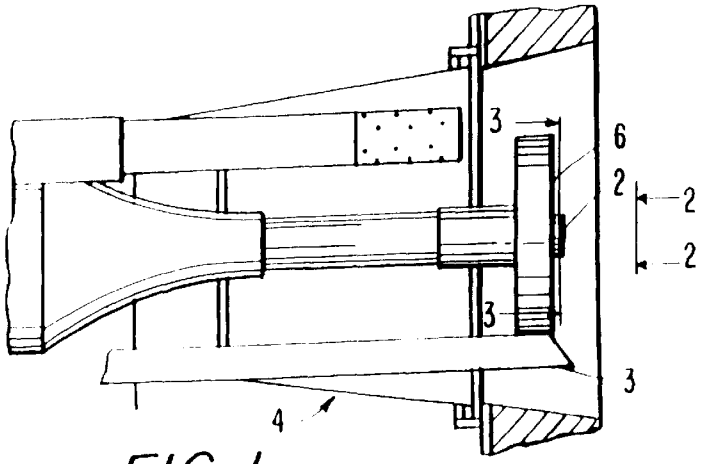
FIG. 1 is a partial sectional elevational view of a furnace windbox in which the atomizer of the present invention is installed.

As seen in FIG. 1, the atomizer 2 of the present invention is shown centrally disposed in a power plant furnace windbox 4. The windbox 4 include a conventional swirler 6 and an array of poker tubes 3 arranged around the swirler 6.

The atomizer 2, as best seen in FIGS. 2, 3, 4 and 5 is provided with a large diameter circular first array of perimeter holes 8, a small diameter circular second array of perimeter holes 38, an external circular flange 10, an internal centrally disposed whirling chamber 12 and a plurality of slots 14 terminating tangentially at the inside upstream opening of the centrally disposed chamber 12. The front surface of the atomizer 2 is a frusto-conical surface 15 terminating in a central circular flat surface 16.

Figure 2:
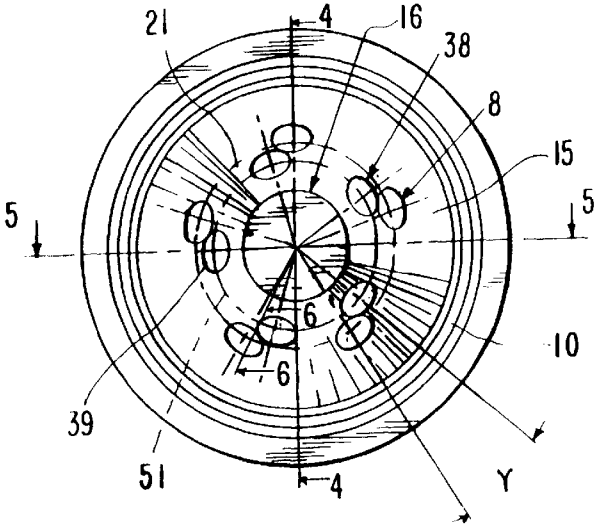
FIG. 2 is a front elevational view of the atomizer of the present invention taken through line 2—2 of FIG. 1.
Figure 3:
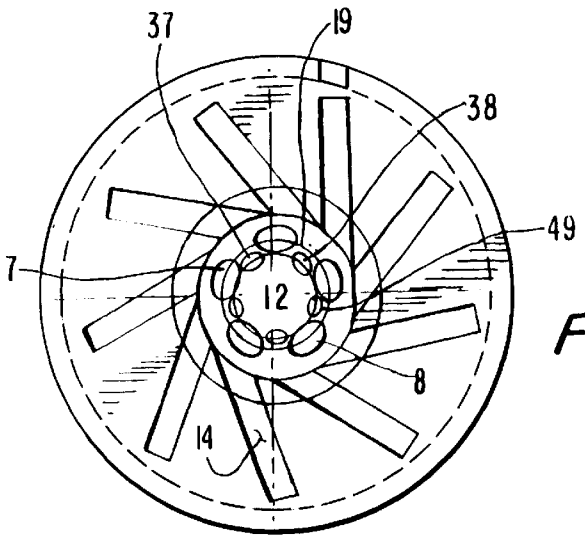
FIG. 3 is a back elevational view of the atomizer of the present invention taken through line 3—3 of FIG. 1.
Figure 5:
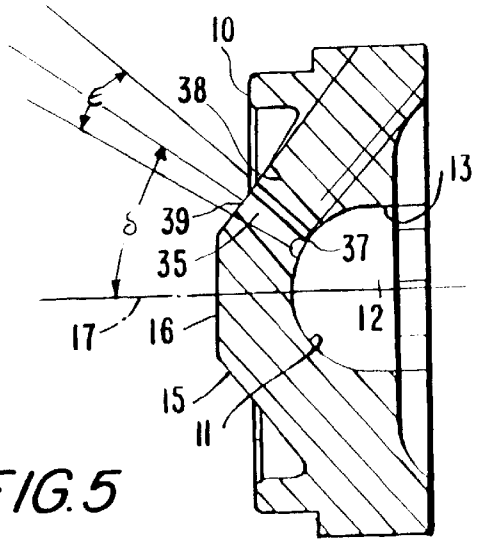
FIG. 5 is a sectional elevational view of the atomizer of the present invention taken through line 5—5 of FIG. 2.
Figure 4:
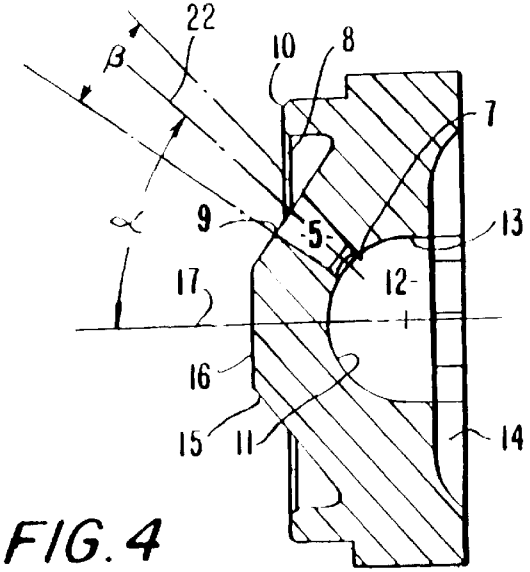
FIG. 4 is a sectional elevational view of the atomizer of the present invention taken through line 4—4 of FIG. 2.
Figure 6:
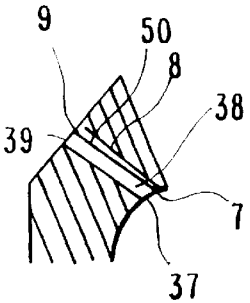
FIG. 6 is a partial sectional view taken through line 6—6 of FIG. 2.

As best seen in FIGS. 2–4, the array of perimeter holes 8 comprise five holes equidistant from the centerline 17 of the centrally disposed whirling chamber 12 and from each other. The perimeter holes 8 are formed at an angle $\alpha$ in the range of 22.5° to 60° and preferably 40° to the centerline 17 of the whirling chamber 12, as best can seen in FIG. 4. As seen in FIG. 5, the perimeter holes 38 are formed at an angle $\delta$ in the range of 22.5° to 60° and preferably 35° to the centerline 17 of the whirling chamber 12. The whirling chamber 12 is formed in a cup-like configuration. The downstream section 11 of the whirling chamber 12 is hemi-spherical and the upstream section 13 is cylindrical. As seen in FIGS. 4 and 6 each of the five perimeter holes 8 has an inner upstream opening 7, an outer downstream opening 9 and a divergent passage 5. As seen in FIGS. 5 and 6 each of the perimeter holes 38 has an inner upstream opening 37, an outer downstream opening 39 and a divergent passage 35.

As best seen in FIG. 2, each perimeter hole 38 is adjacent to a perimeter hole 8 and is offset at an angle $\gamma$ about the center of the atomizer 2.

As best seen in FIG. 6, a wall 50 separates the perimeter holes 8 from the perimeter holes 38.

In the preferred embodiment, the diameter of the cylindrical section 13 is 0.512 inches and the radius of the hemi-spherical section 11 is 0.256 inches. The diameter of a pitch circle 19 made through the center lines of the perimeter holes 8 at the inner upstream opening 7, best seen in FIG. 3, is in the range of 0.300" to 0.350" preferably 0.350", and the diameter of a pitch circle 21 made through the centerline of the outside downstream openings 9 of the perimeter holes 8, best seen in FIG. 2, is 0.680". The diameter of a pitch circle 49 made through the center lines of the perimeter holes 38 at the inner upstream opening 37, best seen in FIG. 3, is in the range of 0.200" to 0.300" preferably 0.271" and the diameter of a pitch circle 51 made through the center lines of the perimeter holes 38 at the outer downstream opening 39 is 0.540". The divergence angle $\beta$ of passage 5 of the perimeter holes 8 is 12° and the divergence angle $\epsilon$ of the passages 35 of the perimeter holes 38 is also 12°. Each of the holes 8 and 38 has an inlet opening 7 and 37 respectively formed with a partial hemi-spherical section which in the preferred embodiment is formed with a 3/16 inch ball mill that penetrates 0.025" into the respective passages 5 and 35. The offset angle $\delta$ is in the range of 10° to 25°, preferably 20°.

Figure 7:
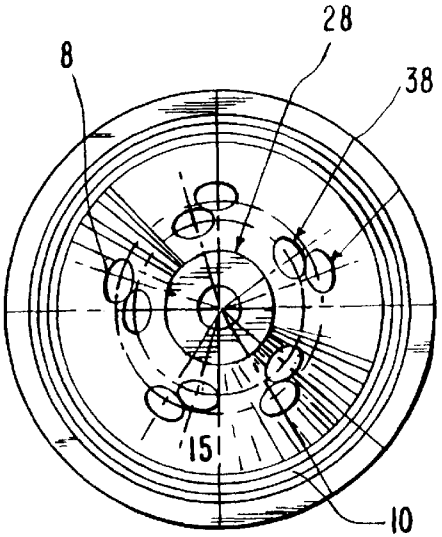
FIG. 7 is a front elevational view of a second embodiment of the atomizer of the present invention.

The embodiment of the atomizer 2 of FIG. 7 is essentially the same as the embodiment of FIGS. 2–6 but includes a centrally disposed hole 28.

In operation oil under pressure up to 1200 psig, is directed by a backing plate (not shown) to the outer perimeter of the rear of the atomizer. The oil under pressure enters the atomizer 2 at the outer edge of the slots 14 cut in the rear of the atomizer 2. The oil is accelerated to high velocity in the slots 14, and jets into the whirling chamber 12 at an angle almost tangent to the outer diameter of the whirling chamber 12. This produces a high velocity rotating flow in the whirling chamber 12 that accelerates as the oil proceeds to the perimeter holes 8 and 38. Oil passes through the perimeter holes 8 and 38, where atomization occurs from a combination of centrifugal force and shearing of the oil by air as it jets into the air stream.

The embodiment of FIG. 7 functions similarly to the embodiment of FIGS. 2–6 but fluidized fuel also discharges from the centrally disposed hole 28 which has a diameter of 3/16 to 5/16 inch. At the exit of the center hole 28, the swirling oil forms a thin film around the perimeter of the hole, which atomizes the oil into small droplets. Centrifugal force from the swirling oil causes the oil to be discharged from the perimeter holes 8 and 38 in an enlarging fan pattern, which results in small droplets that ignite easily.

Figure 8:
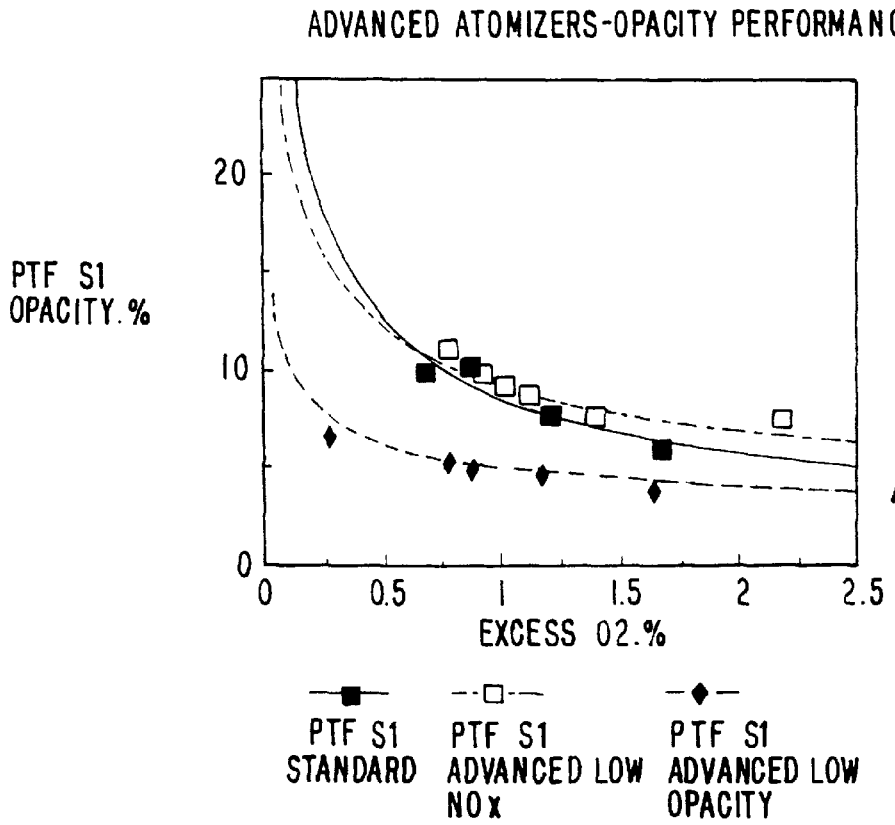
FIG. 8 is a graph illustrating the improved opacity performance of the atomizer of the subject invention.

Extensive tests were conducted to develop the atomizer 2 of the present invention. FIG. 8 displays the improved opacity performance of the atomizer 2 of the present invention compared to the TODD prior art atomizer and the TODD Advanced Low $NO_x$ atomizer described in Ser. No. 08/724,442, filed Oct. 1, 1996 filed coincidentally with this application. The prior art nozzle identified as the standard nozzle differed from the nozzle of the present invention in the location of the perimeter holes 8 and the absence of the second array of perimeter holes 38. In the standard nozzle the divergence angle through the centerline of each perimeter hole to the centerline of the whirling chamber is 42½°; the interior (upstream) pitch circle has a diameter of 0.350 and the exterior (downstream) pitch circle has a diameter of 0.680.

A Todd DYNASWIRL-LN burner employing advanced fuel staging for Residual Fuel (RFO) was used in the test. A single conventional differential pressure atomized burner (RFO gun) is located along the burner centerline, inside the gas pipe.

Figure 9:
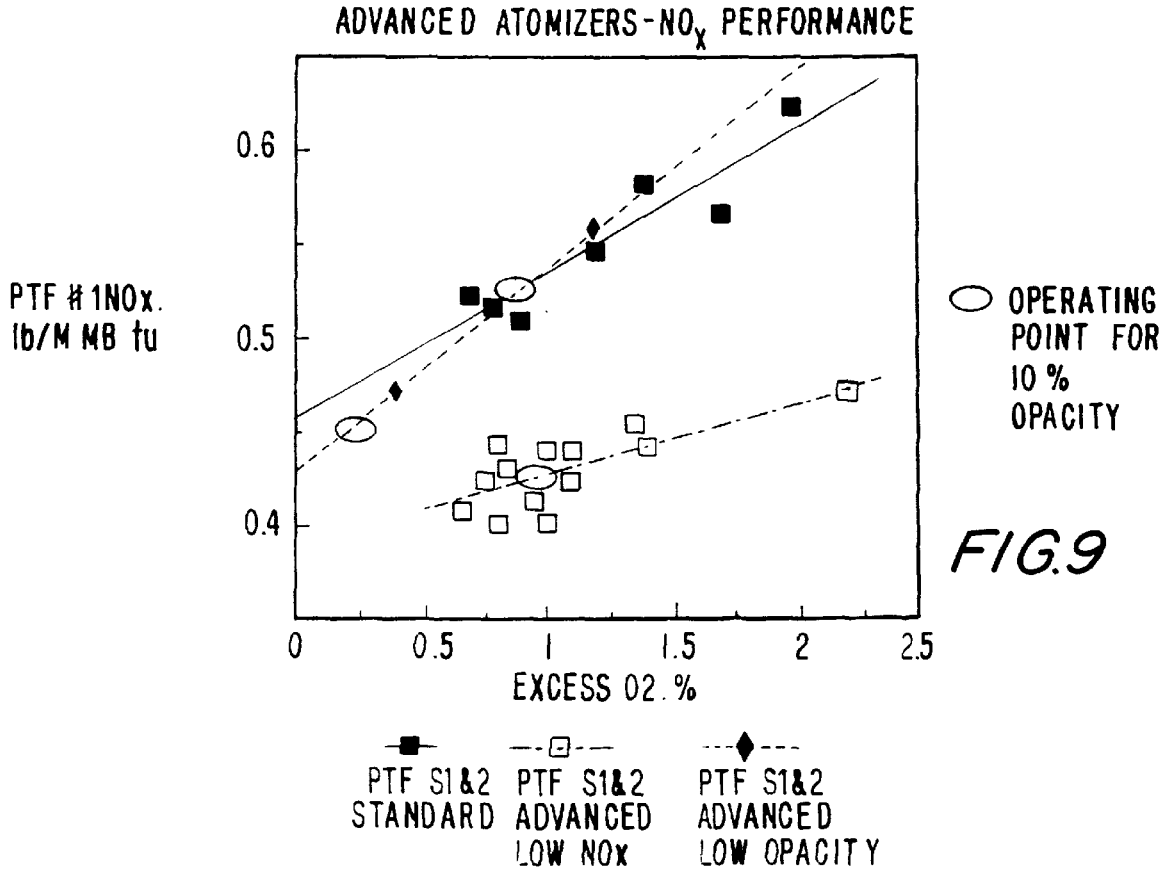
FIG. 9 is a graph illustrating the $NO_x$ performance of the atomizer of the subject invention.

Through the use of the database developed during the course of the tests, spray lab testing and mathematical modeling, the atomizer 2 of the present invention was developed and performed to result in opacity levels generally in the 5% range. Compared to TODD's "standard and advanced low $NO_x$ design, the atomizer of the present invention reduced opacity levels from the 7–12% range to the 4–10% range. The results are reported on FIGS. 8 and 9 wherein PTF #1 Standard refers to the prior art TODD atomizer and #1 Advanced Low $NO_x$ refers to the TODD atomizer developed contemporaneously with the atomizer of the subject invention. #1 Advanced Low Opacity refers to the atomizer 2 of the subject invention.

Although the tests were performed using a differential pressure atomizer (return flow atomizer), the performance will be the same when using a simplex (non-return flow) atomizer.

I claim:

1. An atomizer comprising a whirling chamber;

a first array of perimeter holes arranged around the centerline of the whirling chamber; and a second array of perimeter holes arranged around the centerline of the whirling chamber wherein each perimeter hole of the second array of perimeter holes is offset from a perimeter hole of the first array of perimeter holes; and wherein each perimeter hole is comprised of an upstream inlet opening, a downstream outlet opening and a divergent passage that diverges from the upstream inlet opening to the downstream outlet opening.

2. An atomizer as in claim 1 further comprising upstream inlet openings and downstream outlet openings in each perimeter hole of the first array of perimeter holes and wherein said first array of perimeter holes forms a pattern that defines a pitch circle for said inlet openings and a pitch circle for said outlet openings; and upstream inlet openings and downstream outlet openings in each perimeter hole of the second array of perimeter holes and wherein said second array of perimeter holes forms a pattern that defines a pitch circle for the inlet openings and a pitch circle for the outlet openings of smaller respective diameters than the pitch circles defined by the first array of perimeter holes.

3. An atomizer as in claim 2 wherein the offset angle at which each perimeter hole of the second array of holes is offset from a perimeter hole of the first array of holes is 15°.

4. An atomizer as in claim 3 wherein the perimeter holes of the first array of perimeter holes are equally spaced around the pitch circle defined by the first array of perimeter holes and the perimeter holes of the second array of perimeter holes are equally spaced around the pitch circle defined by the second array of perimeter holes.

5. An atomizer as in claim 4 wherein the whirling chamber is comprised of a cylindrical upstream section and a hemi-spherical downstream section.

6. An atomizer comprising a whirling chamber;

a first array of perimeter holes arranged around the centerline of the whirling chamber; and a second array of perimeter holes arranged around the centerline of the whirling chamber wherein each perimeter hole of the second array of perimeter holes is offset from a perimeter hole of the first array of perimeter holes, said atomizer further comprising a frusto-conical surface on the downstream surface of the atomizer; a circular flange around the frusto-conical surface and wherein each perimeter hole is comprised of an upstream inlet opening, a downstream outlet opening and a divergent passage that diverges from the upstream inlet opening to the downstream outlet opening; and said downstream outlet openings are on the frusto-conical surface.

7. An atomizer as in claim 6 wherein the centerline of each perimeter hole in first array of perimeter holes is at an angle of 22.5° to 60° to the centerline of the whirling chamber; and the centerline of each perimeter hole of the second array of perimeter holes is at an angle of 22.5° to 60° to the centerline of the whirling chamber.

8. An atomizer as in claim 7 wherein the spaced relationship between the first array of perimeter holes, the second array of perimeter holes and the whirling chamber is in a ratio wherein the diameter of cylindrical upstream section of the whirling chamber is 512, the pitch circle defined by the inner openings of the first array of perimeter holes is 350 the pitch circle defined by the inner openings of the second array of perimeter holes is 271; the angle of each perimeter hole of the first array of perimeter holes to the centerline of the whirling chambers is 40° and the angle of each perimeter hole of the second array of perimeter holes to the centerline of the whirling chamber is 35°.

9. An atomizer as in claim 8 wherein each array of perimeter holes is comprised of five holes.

10. An atomizer as in claim 7 wherein the pitch circle defined by the inlet openings of the first array is 0.350 inches; the pitch circle defined by the outlet openings of the first array is 0.680 inches; the pitch circle defined by the inlet openings of the second array is 0.271 inches; the pitch circle defined by the outlet openings of the second array is 0.540 inches; and each perimeter hole upstream inlet is formed in a hemi-spherical configuration.

11. An atomizer as in claim 9 further comprising a centrally disposed hole at the whirling chamber centerline.

12. An atomizer comprising a whirling chamber;

a first array of perimeter holes arranged around the centerline of the whirling chamber; and a second array of perimeter holes arranged around the centerline of the whirling chamber wherein each perimeter hole of the second array of perimeter holes is offset from a perimeter hole of the first array of perimeter holes, said atomizer further comprising upstream inlet openings and downstream outlet openings in each perimeter hole of the first array of perimeter holes and wherein said first array of perimeter holes forms a pattern that defines a pitch circle for said inlet openings and a pitch circle for said outlet openings; and upstream inlet openings and downstream outlet openings in each perimeter hole of the second array of perimeter holes and wherein said second array of perimeter holes forms a pattern that defines a pitch circle for the inlet openings and a pitch circle for the outlet openings of smaller respective diameters than the pitch circles defined by the first array of perimeter holes wherein the offset angle at which each perimeter hole of the second array of holes is offset from a perimeter hole of the first array of holes is 15°; wherein each perimeter hole is comprised of an upstream inlet opening, a downstream outlet opening and a divergent passage that diverges from the upstream inlet opening to the downstream outlet opening; and wherein the first array of perimeter holes and the second array of perimeter holes are comprised of the same number of holes and each perimeter hole of the second array of perimeter holes is adjacent to a perimeter hole of the first array of perimeter holes.

13. A process for combusting fuel comprising the steps of delivering fuel under pressure to a whirling chamber, passing the fuel from the whirling chamber through two arrays of perimeter holes that are offset and adjacent to each other wherein combustion of the fuel produces an opacity level below 10% at an excess $O_2$ level of 0.8 in the furnace.

14. A process as in claim 13 wherein each perimeter hole of the second array is adjacent to the perimeter hole of the first array and offset at an angle.

15. A process as in claim 13 wherein the two arrays of perimeter holes are comprised of a first array wherein each perimeter hole is equidistant from the centerline of the whirling chamber and a second array wherein each of the perimeter holes is equidistant from the centerline of the whirling chamber; and the perimeter holes diverge at an angle away from the centerline of the whirling chamber.

16. A process as in claim 15 wherein each of the perimeter holes has an upstream inlet opening and a downstream outlet opening; said inlet openings of the first array define a pitch circle of 0.350 inches; said outlet openings of the first array define a pitch circle of 0.680 inches; said inlet openings of the second array define a pitch angle of 0.271 inches and said outlet openings define a pitch circle of 0.540 inches; and the diameter of the whirling chamber is 0.512 inches.

17. A process as in claim 16 wherein the fuel is delivered with air to the whirling chamber at a pressure of up to 1200 psi.

* * * * *